US006158061A

United States Patent [19]

Cameron et al.

[11] Patent Number: 6,158,061

[45] **Date of Patent: *Dec. 12, 2000**

[54] SANITARY TOILET WITH INTEGRAL WATER SUPPLY AND MANUAL FLUSH ASSEMBLY

[75] Inventors: David B. Cameron, Brighton; John M. Antos; Charles L. Sargent, both of Ann Arbor, all of Mich.

[73] Assignee: Thetford Corporation, Ann Arbor, Mich.

[ * ] Notice: Under 35 U.S.C. 154(b), the term of this patent shall be extended for 1005 days.

[21] Appl. No.: 08/587,134

[22] Filed: Jan. 16, 1996

Related U.S. Application Data

[63] Continuation of application No. 08/294,596, Aug. 23, 1994, abandoned.

[51] Int. Cl.[7] ..... E03D 5/01

[52] U.S. Cl. ..... 4/300; 004/321

[58] Field of Search ..... 4/300, 321, 323, 4/353, 420, 434, 441; 220/86.2; 92/162

[56] References Cited

U.S. PATENT DOCUMENTS

| | | | |
|---|---|---|---|
| 971,803 | 10/1910 | Tarnawski | 4/315 |
| 1,198,057 | 9/1916 | Ribaysen | 4/315 |
| 1,956,868 | 5/1934 | Lemmon | 92/162 |
| 2,206,948 | 7/1940 | Frankford | 220/86.2 |
| 3,612,338 | 10/1971 | Ekman | 220/86.2 X |
| 3,838,713 | 10/1974 | Tubbs | 220/86.2 X |
| 3,842,445 | 10/1974 | Jones | 4/321 |
| 4,776,631 | 10/1988 | Sargent et al. | 4/321 X |
| 4,947,492 | 8/1990 | Vincent | 4/321 |
| 5,031,249 | 7/1991 | Sargent | 4/321 |

*Primary Examiner*—Robert M. Fetsuga

*Attorney, Agent, or Firm*—Harness, Dickey & Pierce PLC

[57] ABSTRACT

A sanitary toilet system with an integral water supply and manual flush assembly for a recreational vehicle in which a flush water supply tank is provided adjacent a recreational vehicle wall with an inlet extending through the wall, thus eliminating plumbing within the vehicle between a water inlet and the supply tank. A manually operated piston pump is provided in which a clearance exists between the piston and the pump cylinder allowing water to flow past the piston during operation of the pump. This reduces the forces necessary to operate the pump in comparison to a piston in sealing relation to the cylinder.

1 Claim, 2 Drawing Sheets

SANITARY TOILET WITH INTEGRAL WATER SUPPLY AND MANUAL FLUSH ASSEMBLY

This is a continuation of U.S. application Ser. No. 08/294,596, filed Aug. 23, 1994, abandoned.

BACKGROUND AND SUMMARY OF THE INVENTION

The present invention relates to a sanitary toilet system for use in a recreational vehicle and in particular to such a system with an integral water supply and manual flush assembly for pumping flush water from the water supply to the toilet bowl for cleaning of the bowl.

In a recreational vehicle (RV) with a self-contained sanitary toilet system having its own flush water supply tank, it is necessary to provide a means for pumping water from the tank to the toilet bowl. Electric pumps have been employed which are easy to use by merely actuating an electrical switch to turn the pump on and off. However, electric pumps are expensive. Low cost manual pumps have also been used with the most common manual pump being a bellows pump. A bellows pump has a collapsible bellow forming a water chamber, and an inlet and an outlet, each with a check valve. When the bellows is compressed, it pushes water from the bellows past the outlet check valve. Upon subsequent expansion of the bellows, water is drawn into the chamber through the inlet check valve. The bellows, in its rest position, is expanded and projects from the housing upon which it is mounted. The bellows must project from the housing so as to be free from obstructions which would hinder its use. Because the bellows has no internal structure which guides the motion of the bellows upon compression, the maximum size of the bellows is limited to enable easy operation without buckling upon compression. As a result, the pump volume per compression is limited. Another disadvantage with a bellows pump is the relatively high force required for pumping.

It is an object of the present invention to provide a sanitary toilet system having an integral water supply with a manual flush pump which is low in cost, has high volume and requires relatively low pumping efforts.

The toilet system of the present invention includes a manually operated piston pump which is disposed within the flush water supply tank. A handle connected to one end of a piston rod extends from the tank for grasping by a user. The piston is not sealed to the pump cylinder. A clearance between the piston and cylinder produces a small annular space surrounding the piston. This space reduces the force required to operate the pump by avoiding a tight seal between the piston and cylinder. The force required to pump water is significantly less than the force required with a bellows pump. The pumping volume is determined by the stroke and diameter of the piston and can be easily be designed with a greater volume than is possible with a bellows pump. The clearance between the piston and cylinder is large enough that some of the water in the cylinder escapes movement out of the cylinder by flowing past the piston as the piston moves toward the discharge outlet. This reduces the pump efficiency measured by the ratio of the volume of water displaced to the cylinder volume. However, even with this reduced efficiency, the overall pump performance is improved with respect to a bellows pump.

In a preferred embodiment of the sanitary toilet system, a flush water tank is mounted within the body of the recreational vehicle adjacent to an upright wall of the vehicle body. The flush water tank has a fill neck that extends through the body side wall to enable convenient filling of the tank from the exterior of the recreational vehicle. By placing the tank adjacent to the RV side wall, there is no need for pipes in the vehicle from a water inlet to a remotely positioned tank.

Further objects, features and advantages of the invention will become apparent from a consideration of the following description and the appended claims when taken in connection with the accompanying drawings.

DETAILED DESCRIPTION OF THE PREFERRED EMBODIMENT

Figures 1, 2:
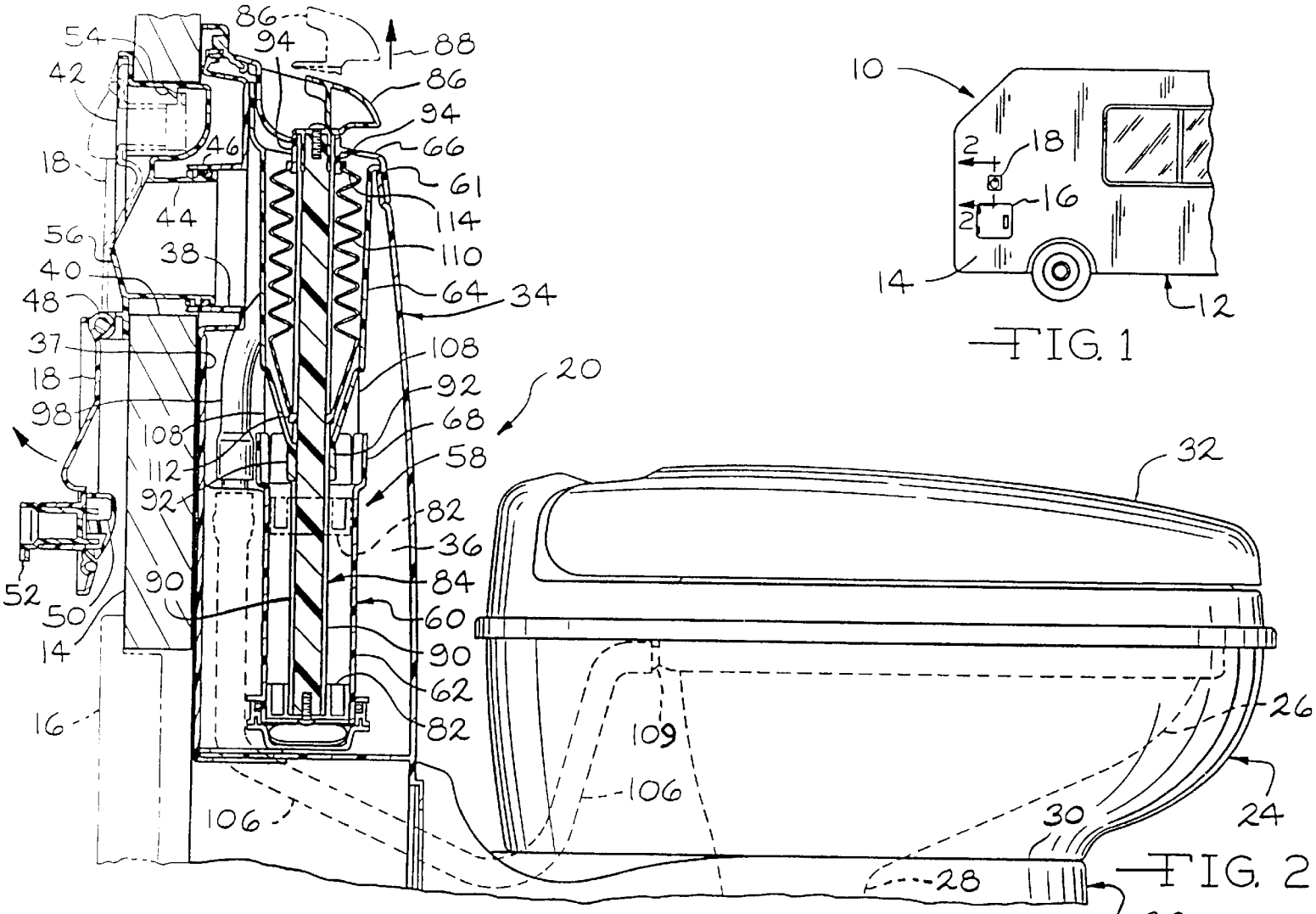
FIG. 1 is a side elevational view of a portion of a recreational vehicle containing the sanitary toilet system of the present invention.
FIG. 2 is a sectional view of the toilet system as seen from substantially the line 2—2 of FIG. 1.
Figure 3:
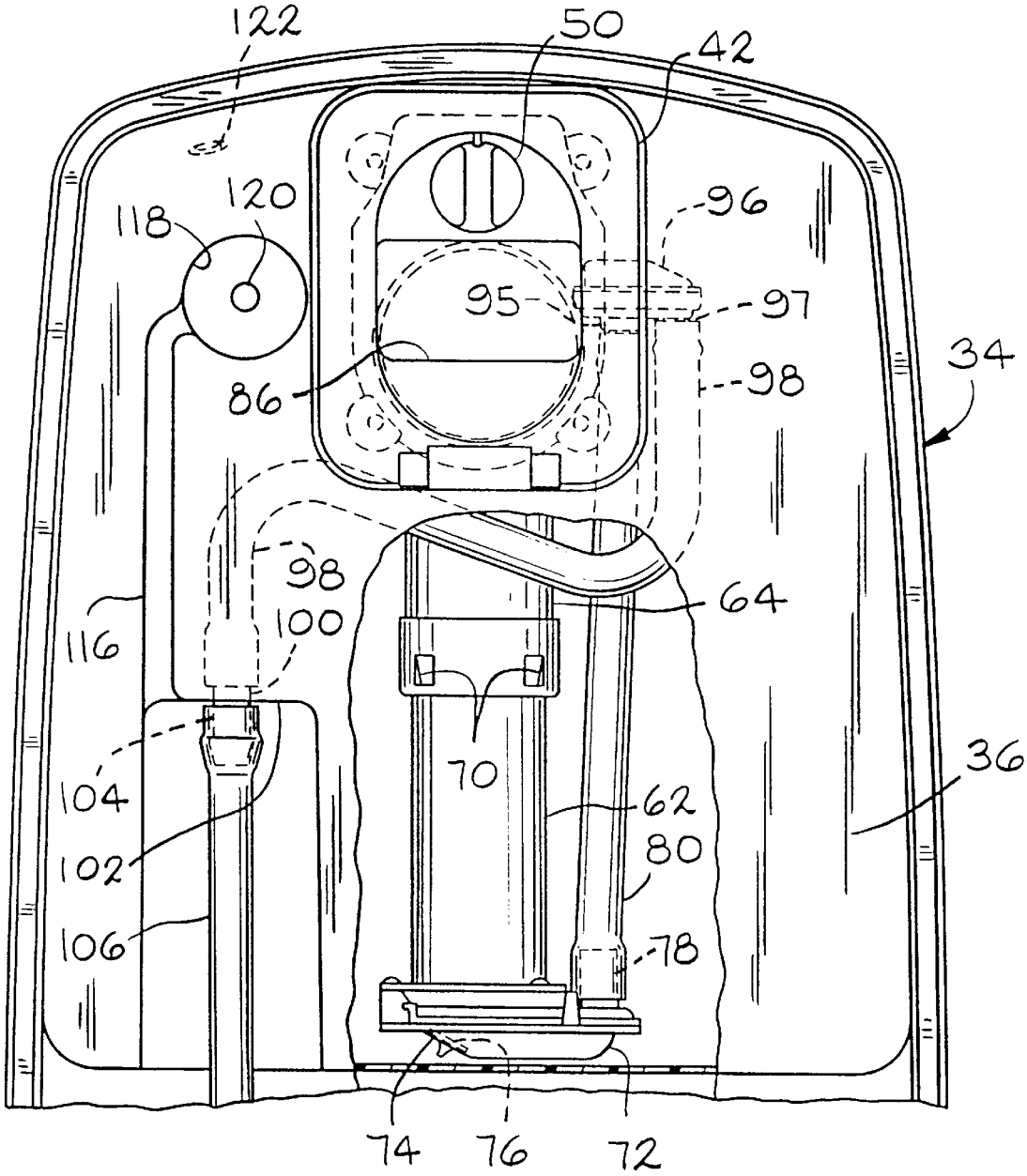
FIG. 3 is a side elevational view of the toilet system when viewed in the same direction as in FIG. 1 with the recreational vehicle side wall removed.

A sanitary toilet system with a manual flush assembly of the present invention is contained within the recreational vehicle 10 shown in FIG. 1. RV 10 includes a vehicle body 12 having a generally upright outer wall 14.

The outer wall 14 has a pair of doors 16 and 18 closing openings in the outer wall. The sanitary toilet system 20 of the present invention is positioned within the vehicle body 12 adjacent to the wall 14 and the doors 16 and 18. The toilet system includes a base section 22 which is positioned adjacent the door 16. The door 16 and its associated opening are used for removing a waste holding tank (not shown) from the vehicle for disposal of toilet waste.

The toilet system includes a bowl section 24 which is mounted up on the base section 22. Bowl section 24 includes a toilet bowl 26 with a bottom discharge outlet 28 that projects through the top wall 30 of the base section 22. The bowl section 24 includes a lid 32 covering the bowl 26.

A tank section 34 is disposed adjacent the outer wall 14, preferably above the base section 22 and in close proximity to the bowl section 24. The tank section 34 includes a flush water supply tank 36 for holding a quantity of flush water to be used in flushing the bowl 26. The tank section is preferably molded of a plastic resin and includes a cylindrical inlet 38 extending into an opening 40 in the outer wall. Inlet 38 is integrally molded with the tank section 34 as a cylindrical neck. The opening 40 is closed by the door 18.

A door frame 42 fits within the opening 40 on the exterior of the vehicle and includes a cylindrical fill tube 44 which seats within the inlet 38 of the tank section 34. An O-ring seal 46 is carried by the tube 44 to seal against the inlet 38, providing a leak tight connection. The tube 44 telescopes within the inlet 38. The amount by which the tube 44 extends into the inlet 38 varies with the thickness of the vehicle outer wall 14. The door frame 42 is secured to the tank section 34 by a plurality of fasteners (not shown) and sandwiches the wall 14 therebetween.

The door 18 is hinged to the door frame 42 for rotation about a pin 48 between an open position shown in solid line in FIG. 2 and a closed position shown in phantom line. In the closed position, the door 18 seals against the fill tube to prevent leakage. A knob 50 is coupled to a latch mechanism 52 carried by the door 18 to secure the door 18 in the closed position to a catch 54 in the door frame. Rotation of the knob 50 operates to disengage the latch 52 from the catch 54 and open the door. The knob 50 and latch 52 can be replaced with a lock mechanism if desired.

A wall 56 is formed in the door frame 42 across the lower section of the tube 44. The wall 56 defines the maximum water level in the tank 36. The tank 36 is filled by pouring water through the neck 38, directly into the tank 36. There are no pipes or other plumbing connections in the recreational vehicle between the tank 36 and the exterior of the vehicle body.

The wall 37 of the tank, which abuts the vehicle wall 14, contains a vertical channel 116 outside the tank which extends upward from the horizontal tank wall 102. Channel 116 leads to a recess 118 having an aperture 120 leading into the tank 36. Another aperture 122 is formed in the tank top wall. The channel 116 and the recess 118 provide a path for a wire which is connected to a fluid level sensor in the base section, adjacent to the removable waste tank. The wire passes through the aperture 120 into the tank and connects to a LED on the top wall at the aperture 122. When the waste tank nears full capacity, the LED is activated to alert the toilet users of the need to empty the waste tank. The apertures 120, 122 are sealed to prevent water leakage.

A pump assembly 58 is disposed within the tank 36 for manually pumping water from the tank to the toilet bowl. The pump assembly 58 includes a cylinder 60 formed from a lower cylinder section 62 and an upper cylinder section 64. The pump cylinder 60 is inserted into the tank 36 through an open upper end 61 of the tank. Upper end 61 is closed with a cover 66 which forms the top of the cylinder 60. The upper section 64 of the cylinder is telescoped into an enlarged upper end portion 68 of the lower section and is held in place by snap-fit connectors 70. A base 72 at the lower end of the cylinder includes a water inlet 74 for receiving the water from the tank 36. Water flow through the inlet 74 is controlled by a flapper valve 76. The base 72 also includes an outlet fitting 78 to which a hose 80 is connected.

A piston 82 is movable axially within the lower section 62 of the cylinder between the lower position shown in solid line and the upper position shown in phantom line. The piston is coupled to a piston rod 84 which extends the length of the cylinder through the cover 66. A handle 86 is connected to the upper end of the rod 84, above the cover 66. The piston 82 is raised and lowered by raising and lowering the handle 86 as shown by the arrow 88. The piston rod has a pair of longitudinal grooves 90 diametrically opposite one another. The ribs 92 at the lower end of the upper cylinder section 64 and the ribs 94 in the cover 66 are disposed in the grooves 90. The ribs within the grooves of the piston rod prevent rotation of the piston rod about its longitudinal axis.

The piston 82 at the bottom of the rod 84 has an outside diameter which is less than the inside diameter of the lower cylinder section 62 by an amount in the range of 0.004–0.020 inches. This smaller piston diameter produces an annular space between the piston and the cylinder. As a result of this annular space, the piston is not in a sealing relation with the cylinder and the force necessary to move the piston within the cylinder is greatly reduced in comparison to a piston that is in sealing relation with the cylinder. As a consequence of this annular space, during downward pumping motion of the piston, a certain amount of water will flow past the piston and remain in the cylinder as opposed to being discharged through the outlet fitting 78 into the hose 80.

With the water flowing between the piston and cylinder, the pump efficiency measured by the ratio of the volume of water displaced from the cylinder to the cylinder volume will be less than 100%. Testing with a pump having a cylinder inside diameter of 1.770 inches and a 10 cm piston stroke has found that a clearance of 0.002 inches per side between the piston and the cylinder results in a 96% pump efficiency. As the clearance per side increases, the pump efficiency gradually declines to an efficiency of about 63% with a 0.010 inch clearance per side. Within the efficiency range of 63%–96%, pump performance is more than sufficient for effective flushing of the bowl 26 while also providing low pumping forces.

During the upward stroke of the piston 80, the flapper valve 76 will open, allowing water to flow into the cylinder, filling the space between the piston 82 and the cylinder base 72. Upon the downward stroke of the piston, the flapper valve 76 will close, preventing the flow of water from the cylinder back to the tank 36. Instead, the water flows through the outlet fitting 78 into the hose 80. The other end of the hose 80 is connected to the inlet 95 of a vacuum breaker 96. A second hose 98 is connected to the outlet 97 of the vacuum breaker and directs the water to a fitting 100 in the wall 102 of the tank. A second fitting 104 on the opposite side of the wall 102 is connected to a third hose 106 which, along with the hoses 80 and 98, functions as a means forming a conduit between the pump outlet 97 and the bowl 26. The hose 106 is connected to a nozzle 108 in the bowl 26 for directing water into the bowl. The vacuum breaker 96 acts as a check valve to prevent formation of a siphon drawing water in the hose 106 back into the pump cylinder. The vacuum breaker 96 does not create undesired resistance to water flow as does a conventional check valve.

The flapper valve 76, while preventing the return of water from the cylinder into the tank during pumping, does not prevent the flow of water into the cylinder when the pump is not in use. With the annular space between the piston and the cylinder, water will fill the cylinder up to the level of water within the tank 36. During the upward stroke of the piston, the water above the piston must be removed from the cylinder. The upper cylinder section 64 has a pair of open windows 108 which allow water above the piston to flow out of the cylinder and into the tank on the upward stroke of the piston.

A flexible accordion style boot 110 surrounds the piston rod 84 within the upper cylinder section. The lower end 112 of the boot is sealed to the piston rod while the upper end 114 of the boot is sealed to the cover 66. The boot forms a seal to prevent water leaking from the tank 36 through the cover around the piston rod. The use of the accordion style flexible boot avoids the need for a high friction seal between the cover 66 and piston rod 84.

The use of the piston pump provides a higher volume flow from the pump with each cycle of the pump as compared with a bellows pump. In addition, the force needed to operate the pump is lower than the force needed with a bellows pump. When the pump is not in use, the rod 84 is disposed within the cylinder so that the handle does not project from the tank section 34. The sanitary toilet system with an integral water supply is convenient in that it locates the flush water tank adjacent to the outer wall of the recreational vehicle body. This eliminates the need for any plumbing connections between the inlet at the vehicle wall and the tank itself.

It is to be understood that the invention is not limited to the exact construction or method illustrated and described above, but that various changes and modifications may be made without departing from the spirit and scope of the invention as defined in the following claims.

We claim:

1. A sanitary toilet system comprising: a bowl having an open upper end and a bottom discharge outlet; a tank for holding a quantity of flush water, said tank having an inlet through which said tank is filled with water;

a manually operable pump at least partially disposed in said tank for pumping flush water from said tank to said toilet bowl, said pump having a generally upright pump body defining an axis and having a lower end, said pump body having a water inlet with a valve at said lower end for receiving water from said tank and a pump outlet at said lower end through which water is pumped to said bowl; and means forming a conduit between said pump outlet and said toilet bowl whereby water pumped through said pump outlet is delivered to said toilet bowl;

said pump further having a piston slidable within said pump body for pumping movement axially thereof, said piston being upwardly movable within said pump body away from said lower end so as to draw water into said pump body through said inlet and said piston being downwardly movable within said pump body toward said pump outlet so as to force water from said pump body through said pump outlet, means forming an opening in said pump body above said piston whereby water in said pump body can flow between said tank and said pump body and a clearance between said piston and said pump body so that some of the water escapes movement out of said pump body when said piston is moved downward by flowing through said clearance between said piston and said pump body whereby movement of said piston in said pump body is with reduced force on the piston relative to pumps in which the piston is in a sealing relation with the pump body, wherein said piston and said pump body are substantially circular in cross section and said piston has a diameter which is less than a diameter of said pump body by 0.004 to 0.020 inches.

* * * * *